US006397415B1

(12) United States Patent
Hsieh

(10) Patent No.: US 6,397,415 B1
(45) Date of Patent: Jun. 4, 2002

(54) ORTHOPEDIC PILLOW

(76) Inventor: Hsuan-Chi Hsieh, 411 Huntington Dr., #114, Arcadia, CA (US) 91007

( * ) Notice: Subject to any disclaimer, the term of this patent is extended or adjusted under 35 U.S.C. 154(b) by 0 days.

(21) Appl. No.: 09/629,895

(22) Filed: Jul. 31, 2000

(51) Int. Cl.[7] ..... A47G 9/10
(52) U.S. Cl. ..... 5/644; 5/636
(58) Field of Search ..... 5/636, 639, 640, 5/644, 645

(56) References Cited

U.S. PATENT DOCUMENTS 4,724,560 A * 2/1988 Christie ..... 5/644
4,847,931 A * 7/1989 Bard ..... 5/644
5,257,429 A * 11/1993 Genis ..... 5/636
5,642,544 A * 7/1997 Munoz ..... 5/644
5,916,088 A * 6/1999 Gueli ..... 5/644

FOREIGN PATENT DOCUMENTS

GB 2026315 A * 2/1980 ..... 5/645

* cited by examiner

*Primary Examiner*—Michael F. Trettel
(74) *Attorney, Agent, or Firm*—Troxell Law Office PLLC

(57) ABSTRACT

An inflatable cervical pillow formed of airtight thermoplastic material comprises a water chamber including a valve projected above the surface thereof, and an air chamber including a valve projected above the surface of water chamber. Pillow is curved about 35 to 45 degrees from the lowest front end to the highest rear end. The chambers are flexibly fitted each other. The air chamber has a corrugated surface such that water in the water chamber is operable to flow toward the corrugated surface of the air chamber. The invention is ergonomic such that musculoskeletal discomfort in the head and the neck of the user is totally eliminated after sleep.

11 Claims, 7 Drawing Sheets

ORTHOPEDIC PILLOW

BACKGROUND OF THE INVENTION

1. Field of the Invention

The present invention relates to an orthopedic pillow and more particularly to an inflatable cervical pillow with improved characteristics.

2. Description of Related Art

Generally speaking, sleep time per day is eight hours for an adult. Good sleep is important for the recovery of a fatigued body. As such, a variety of health pillows aimed at providing so-called good sleep are commercially available. However, many of these are merely gimmicks of one sort or another. Most common drawbacks of these pillows are elastic failure, deformation, too hard/soft, or the like. It is common for people who use the above so-called health pillows to suffer headache, neck numbness, spinal discomfort, or the like.

Also, the filling of above pillow is generally selected from the group consisting of foam rubber, cotton, teas, and grains. This causes the above drawbacks. Further, such conventional pillows are poor in ventilation. As such a user often feels muggy while sleeping.

Thus, it is desirable to provide an improved inflatable cervical pillow in order to overcome the above drawbacks of prior art.

SUMMARY OF THE INVENTION

It is an object of the present invention to provide an ergonomic inflatable cervical pillow for mitigating and/or obviating the aforementioned problems of prior art. The pillow is configured to adjust its shape by the weight of the head of a user. Preferably, the pillow has an average curvature of 40 degrees from the lowest front end to the highest rear end and the cross-section thereof has a parabolic shape and a slant of 35 to 45 degrees. Various benefits are obtained by the pillow. For example, the neck of user is fully supported, the pillow is deformed free after long time of use, and the muscle of the neck and the head of user is totally relaxed while sleeping, thereby providing a good sleep.

It is another object of the present invention to provide an inflatable cervical pillow wherein two air chambers are formed to effect a smooth mutual movement thereof. The pressed air chambers deform and squeeze each other so as to transmit a resultant force for sufficiently supporting the weight of the neck and the head of a user.

It is still another object of the present invention to provide an inflatable cervical pillow wherein the surface area of air chamber is larger than that of water chamber. The air chamber has a corrugated surface such that water (or any or other filled liquid) in the water chamber is operable to flow toward the corrugated surface of the air chamber for cooling the air chamber because the temperature of water is always 3 to 5° C. below that of air. This can make user feel cool and comfortable, thus making a good sleep.

It is yet another object of the present invention to provide an inflatable cervical pillow wherein water chamber is configured to contain a liquid having a desired temperature. For example, cold water is filled in water chamber for maintaining the coolness of pillow while sleeping. Alternatively, crushed ice is filled in water chamber for applying to the body so as to lower the body temperature or ease pain when user is ill or hurt. Alternatively, hot water is filled in water chamber or a heating pad is mounted on the bottom of pillow for applying to the body so as to lower the body temperature or reduce a swelling. Further, the pillow is a good medical means for circulating blood around the head and the neck of user while sleeping; thereby eliminating musculoskeletal discomfort in the shoulder.

It is a further object of the present invention to provide an inflatable cervical pillow which utilizes the softness and the shapeless characteristics of water and air as well as the characteristics of water such as horizontal transmission of force, heat convection (i.e., the temperature of water is always 3 to 5° C. below that of air), and buoyancy balance, resulting in a deformed free pillow. The pillow also has medical effect.

It is still further object of the present invention to provide an inflatable cervical pillow which is shaped to conform to the head and the cervix and has a curvature of 35 to 45 degrees from the lower front end to the higher rear end. It is possible to fill air and liquid into respective chambers. Air and liquid chambers are deformed temporarily in a degree proportional to the weight of the neck and the shoulder of a user, thereby uniformly and totally supporting the head. User does not feel any pressure exerted thereon while sleeping. Hence, the cervix is free from abnormal pressure. The pillow can not only protect a healthy cervix but also adjust an abnormal or dislocated cervix in a natural way.

It is yet further object of the present, invention to provide an inflatable cervical pillow formed of toxic free S-PVC material. Thus it is easy to wash. Also, the pillow is clean, dust free, microorganism free, and dry in storage. Further, most allergic persons are permitted to use the pillow.

To achieve the above and other objects, the present invention provides an inflatable cervical pillow formed of airtight plastic material comprising a water chamber including a valve projected above the surface thereof, and an air chamber including a valve projected above the surface of water chamber. The surface area of air chamber is larger than that of water chamber. The filled air chamber still has a corrugated surface such that liquid in the water chamber is operable to flow toward the corrugated surface of the air chamber for cooling the air chamber. Air chamber is deformed and squeezed by water chamber for supporting the head of user. Preferably, the cross-section of the pillow has a parabolic shape. The pillow is configured to be curve from the lowest front end to the highest rear end with respect to the neck. Thus, the head is located at the parabola while sleeping. Liquid in the water chamber is forced to move forward when the inclined surface of the pillow is pressed by the head. Accordingly, air chamber within water chamber is moved up to move upper air and water chambers upward to support the neck. Hence, the head and the neck of user is supported by the air and water chambers of the pillow of the invention while sleeping. Moreover, liquid in water chamber and air in air chamber are flexibly fitted each other. As such, the head and the neck are sufficiently and comfortably supported irrespective of the moving of the body while sleeping, resulting in a good sleep.

The above and other objects, features and advantages of the present invention will become apparent from the following detailed description taken with the accompanying drawings.

DETAILED DESCRIPTION OF THE PREFERRED EMBODIMENTS

Figure 1:
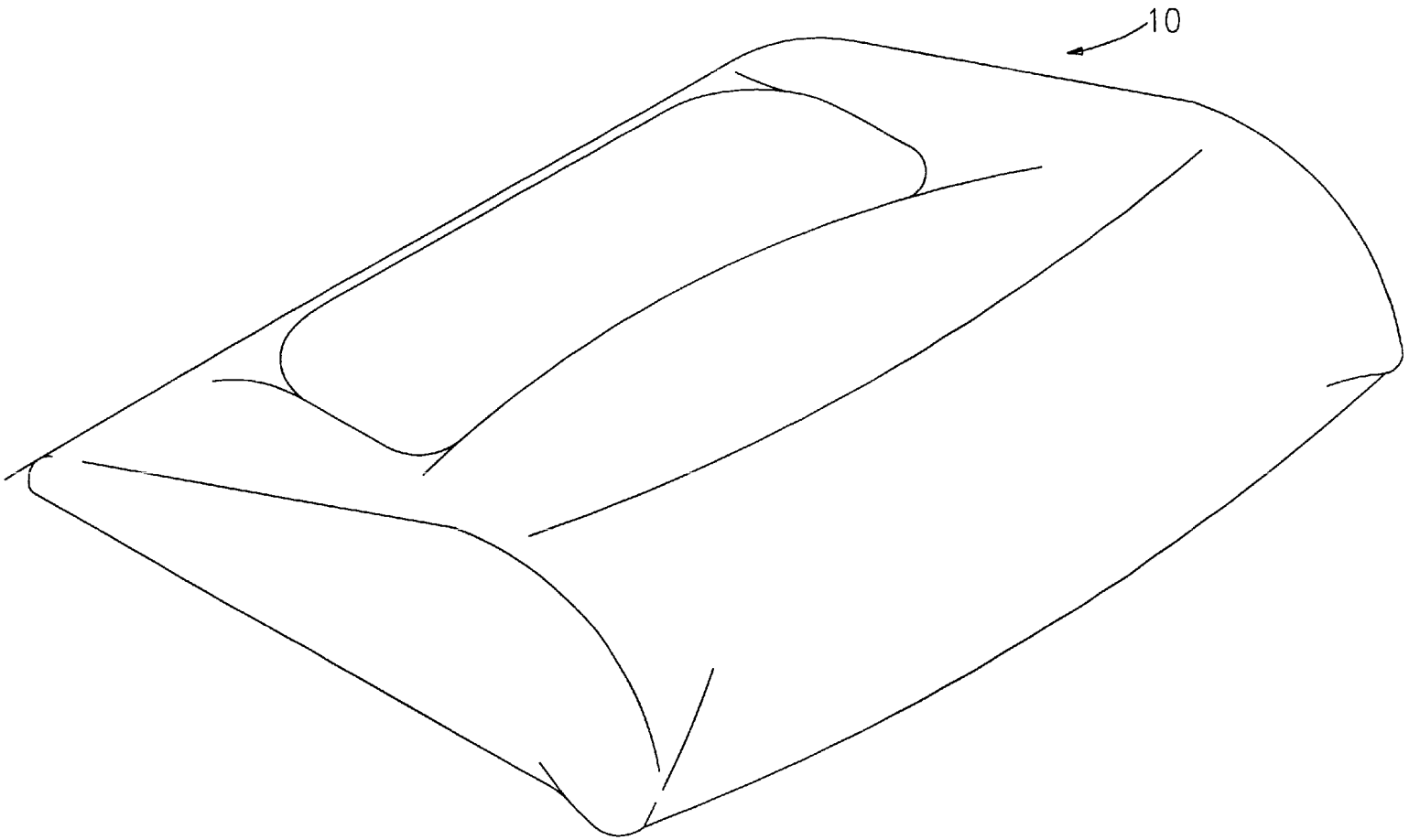
FIG. 1 is a perspective view of an inflatable cervical pillow according to the invention.
Figure 2B:
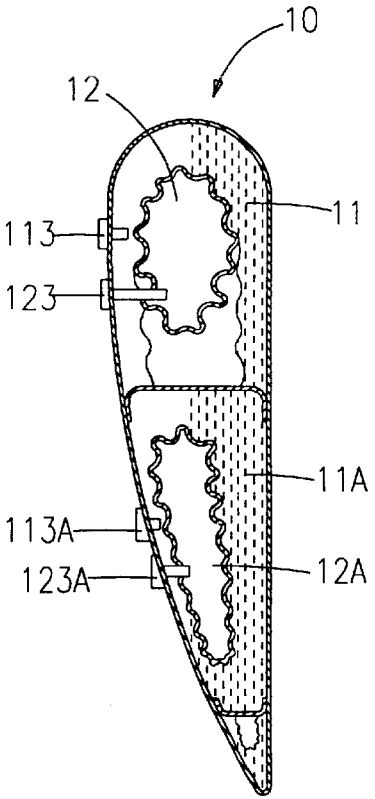
FIGS. 2A and 2B are top and side cross-sectional views of a first embodiment of inflatable cervical pillow according to the invention respectively, the pillow being not inflated.
Figure 2A:
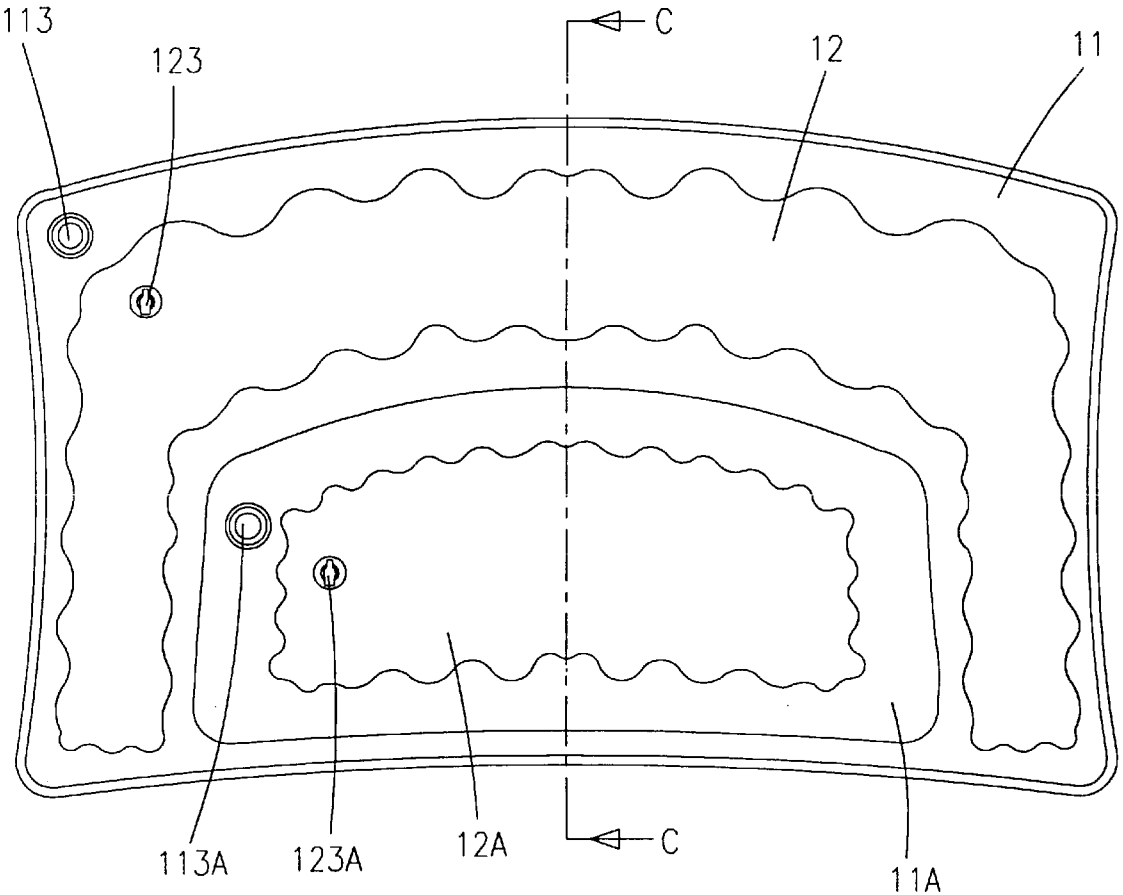
Figure 3B:
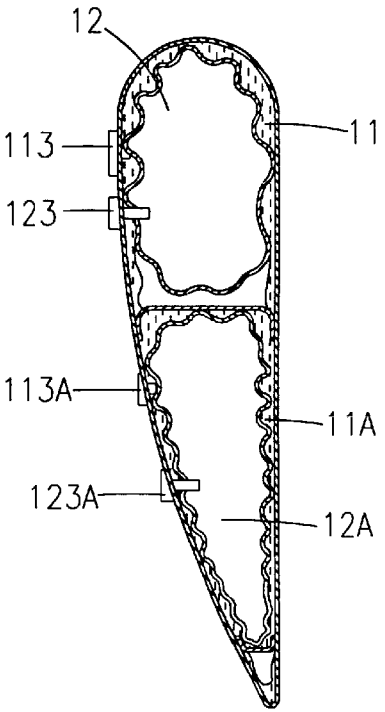
FIGS. 3A and 3B are similar to FIGS. 2A and 2B respectively, the pillow being inflated.
Figure 3A:
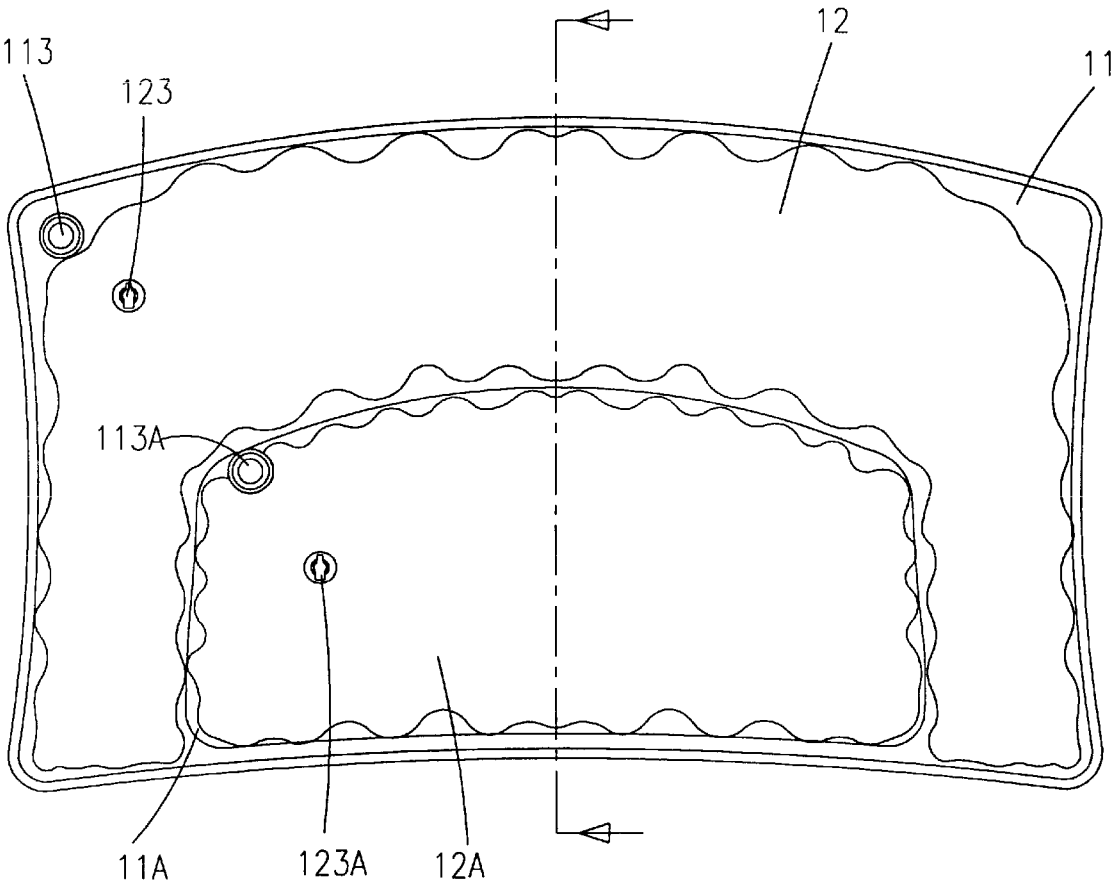

Referring to FIGS. 1 to 3B, there is shown a first embodiment of inflatable cervical pillow 10 constructed in accordance with the invention. The pillow 10 is formed of airtight PVC plastic material (e.g., S-PVC) having a plurality of chambers each being filled with fluid (e.g., air or water). Pillow 10 is configured and curved about 35 to 45 degrees from the lowest front end to the highest rear end so as to be ergonomic. Pillow 10 comprises a first water chamber 11, a substantially U-shaped first air chamber 12 enclosed by first water chamber 11, a second water chamber 11A surrounded by two arm portions of first air chamber 12, and a substantially parallelepiped second air chamber 12A enclosed by second water chamber 11A. Each chamber has a valve 113, 113A, 123, or 123A for permitting fluid to fill in. The surface area of first air chamber 12 is larger than that of first water chamber 11, while the surface area of second air chamber 12A is larger than that of second water chamber 11A. Each of first and second air chamber 12 and 12A has a corrugated surface. As such, inflated air chamber 12 and 12A are capable of being flexibly fitted in water chamber 11 and 11A respectively. Also, the heat transfer between air chambers and water chambers may result in a balance state which in turn brings a degree of comfort to the user. Valve 123 is passed through first water chamber 11 to reach first air chamber 12. The top of valve 123 is projected above the surface of first water chamber 11 so as to facilitate fluid filling and removing in a known manner. Similarly, the tops of valves 113A and 123A both are projected above the surface of first water chamber 11 so as to facilitate fluid filling and removing. By suitably filling such multiple chambers 12, 12A, 11, and 11A, it is possible to obtain an optimal support for the head and the neck of the user.

Figure 4B:
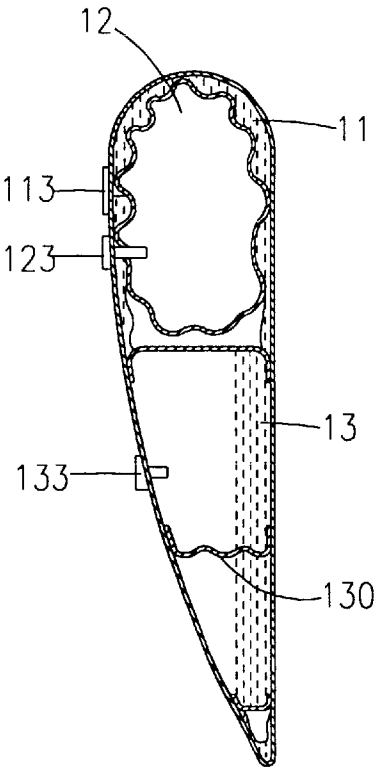
FIG. 4B is a cross-sectional view taken along line C—C of FIG. 4A.
Figure 4A:
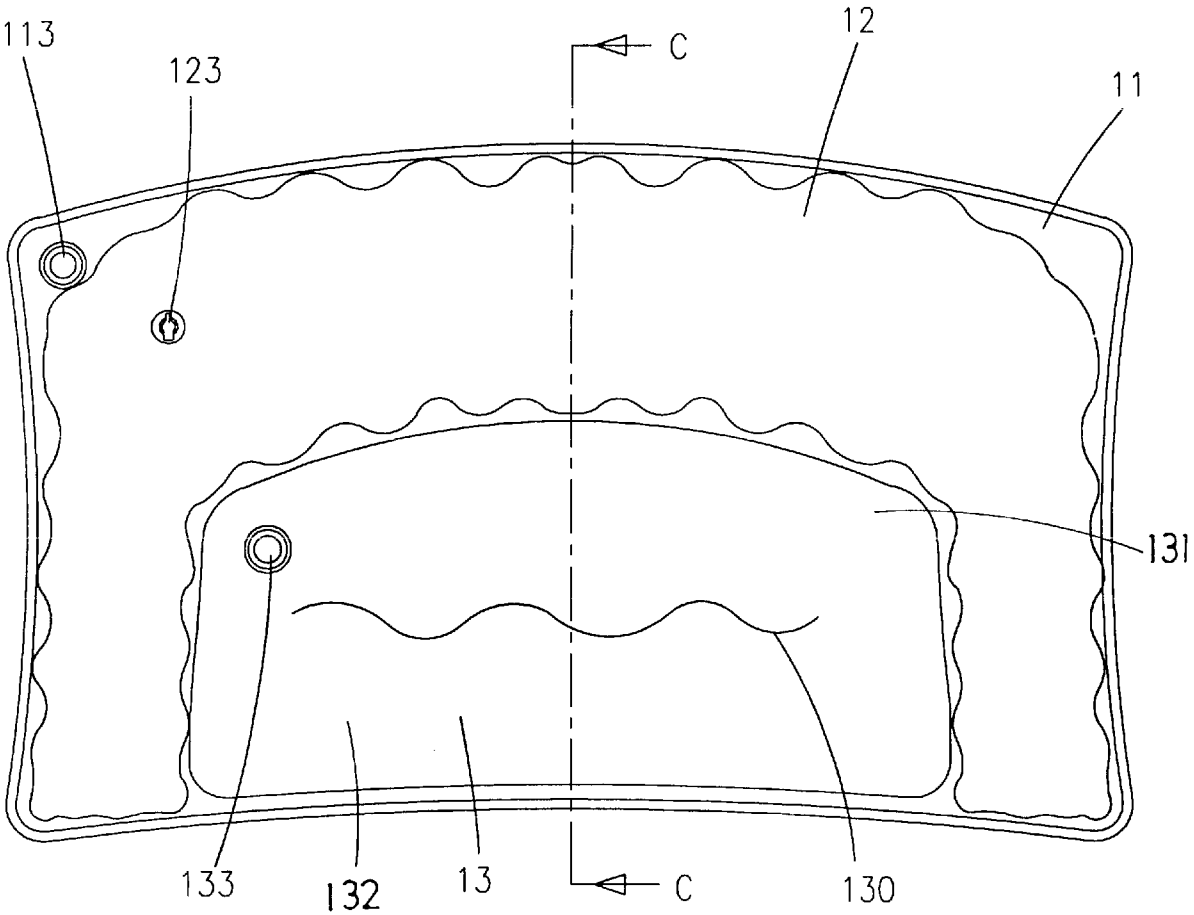
FIG. 4A is a top cross-sectional view of a second embodiment of inflatable cervical pillow according to the invention, the pillow being inflated.

Referring to FIGS. 4A and 4B, there is shown a second embodiment of the invention. This embodiment is, substantially configured the same as the first one except the following. The second water chamber 11A and third air chamber 12A of first embodiment are replaced by an elongate central chamber 13. Central chamber 13 comprises a valve. 133 projected above the surface of first water chamber 11 and a divider 130 for. dividing the interior into a first sub-chamber 131. and a second sub-chamber 132 in fluid communication with the first sub-chamber 131. User may choose to fill water or air into sub-chambers 131 and 132. Such configuration has a more effective pressing on first water chamber 11, thus bringing more comfort to user. As an implementation in summer, user may fill cold water into first water chamber 11 and central chamber 13 or alternatively, fill cold water into first water chamber 11 and. air into first air chamber 12 and central chamber 13 respectively. This may cool the head and the neck of user. Also, it is light in weight, thus facilitating carrying. In contrast as an implementation in winter, user may fill hot air or water into chambers or alternatively, install a heating pad on the side of first water chamber 11. This may bring warmth to the head and the neck of user. Also, it is possible to adjust the height of pillow by suitably adjusting the amount of filling of each chamber.

Figure 5B:
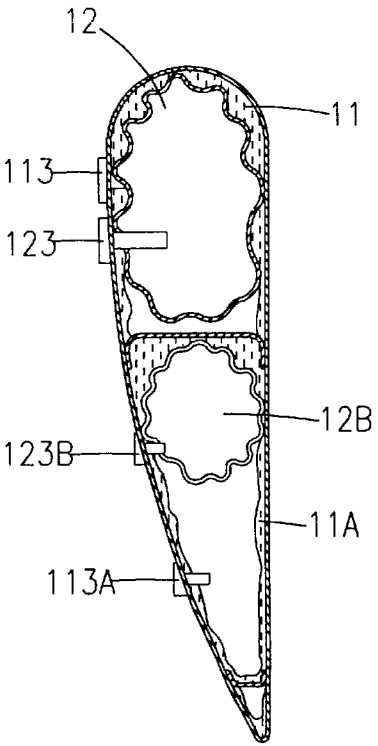
FIG. 5B is a cross-sectional view taken along line C—C of FIG. 5A.
Figure 5A:
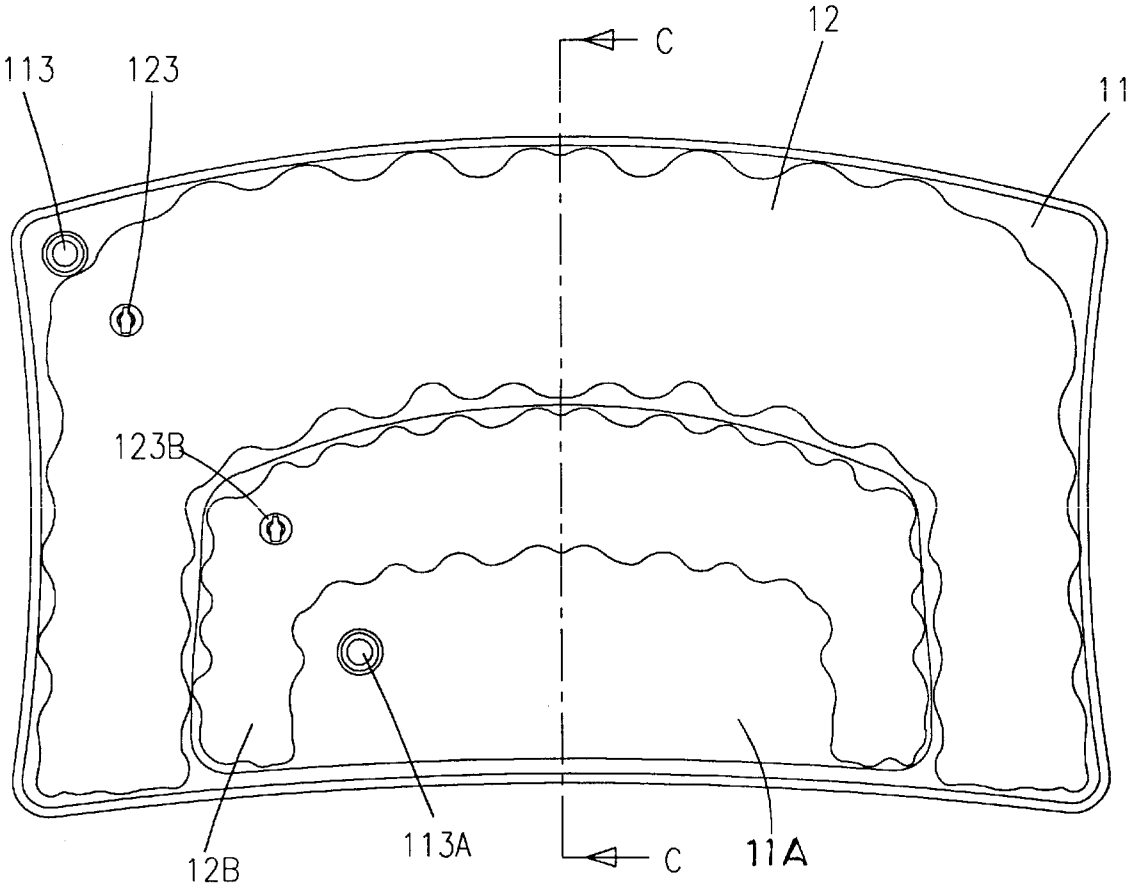
FIG. 5A is a top cross-sectional view of a third embodiment of inflatable cervical pillow according to the invention respectively, the pillow being inflated.

Referring to FIGS. 5A and 5B, there is shown a third embodiment of the invention. This embodiment is substantially configured the same as the second one except the following. Divider 130 is eliminated. Moreover, a substantially U-shaped second air chamber 12B is formed in central chamber 13. The second air chamber 12B comprises a valve 123B projected above the surface of first water chamber 11. Central chamber 13 and second air chamber 12B are pressed to push first water chamber 11 and first air chamber 12 upward for enhancing the support on the neck of user when use.

Figure 6B:
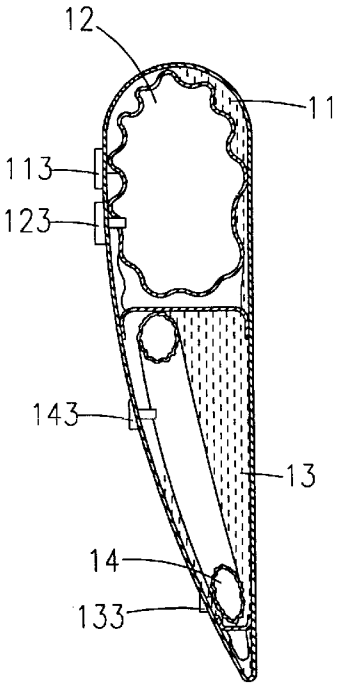
FIGS. 6A and 6B are top and side cross-sectional views of a fourth embodiment of inflatable cervical pillow according to the invention respectively, the pillow being inflated.
Figure 6A:
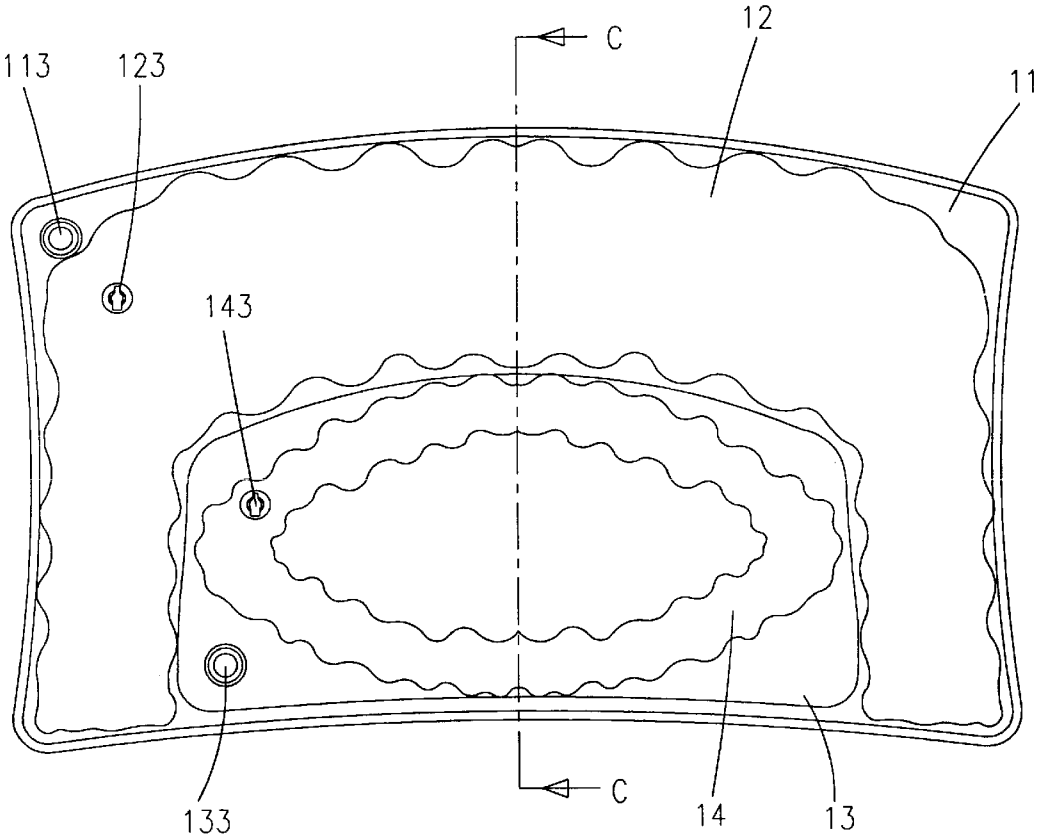

Referring to FIGS. 6A and 6B, there is shown a fourth embodiment of the invention. This embodiment is substantially configured the same as the third one except the following. In this embodiment, a ring-shaped air chamber 14 having a corrugated surface is formed in central chamber 13. Air chamber 14 comprises a valve 143 projected above the surface of first water chamber 11. Air chamber 14 is floated on central chamber 13. Air chamber 14 is cooled by central chamber 13 filled with cold water. As. such, air chamber 14 may tend to push first water chamber 11 and first air chamber 12 forward when air chamber 14 is pressed for further enhancing the support on the neck of user when use.

Figure 7A:
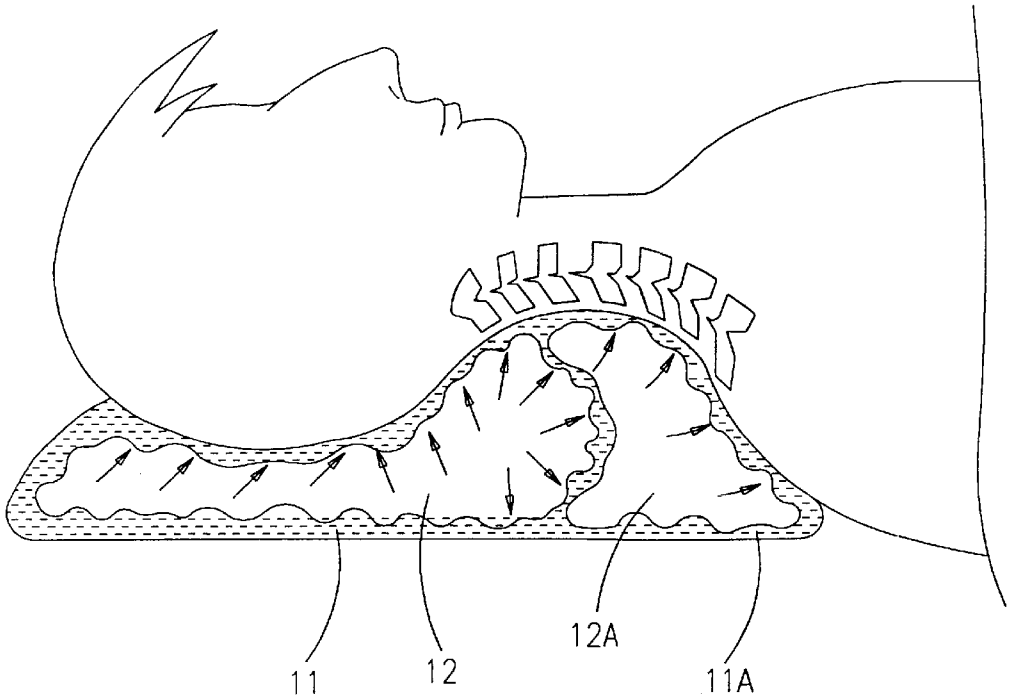
FIG. 7A is a cross-sectional view of the pillow engaging the back of the head, the neck, and the topmost part of the spine of a user.

Referring to FIG. 7A it is designed that the front of pillow 10 is extended about one centimeter toward the shoulder of a user in the first embodiment. As illustrated, pillow 10 is engaged with the back of the head, the neck, and the topmost first and even second segments of the spine of the user. In detail, second air chamber 12A and second water chamber 11A are pressed by the back of the head of the user. Further, as stated above, the surface of pillow 10 is configured to be curved about 40 degree. These two portions combine to cause second air chamber 12A and second water chamber 11A to push first air chamber 12 and first water chamber 11 upward for enhancing the support on the neck and the shoulder of user when use.

Figure 7B:
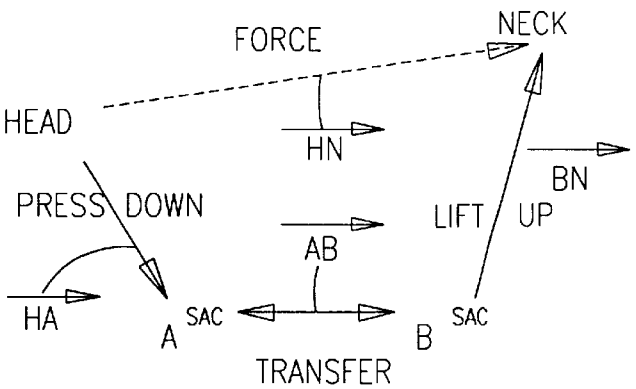
FIG. 7B is a vector diagram illustrating the pressure distribution when the pillow is used.

FIG. 7B is a vector diagram illustrating the pressure distribution when the pillow is used. In detail, first water chamber 11 and first air chamber 12 are pressed down by the head of user. As such, water in water chamber is forced to flow toward bottom right direction as indicated by arrow A with one component represented by vector HA and a neck component represented by vector HN. Also, water in the bottom of water chamber is forced to flow toward opposite directions as indicated by vector AB. An upward pushing force (represented by vector BN) is generated from the surface of pillow abutted on the neck of user. This pushing force is further obstructed by second air chamber 12A. As such, first and second air chambers are pressed to raise the underside portion of the neck of user for adhering and supporting the neck of user. In other words, the pressure from the head of user forces water in first water chamber 11 to generate components HA and HN. Further, water in the bottom of water chamber flows toward opposite directions as indicated by vector AB. An upward pushing force indicated by vector BN is generated by water in the bottom right direction. As such, the resultant force F of first air chamber is the addition of vectors HN, HA, AB, and BN (i.e., F=HN+HA+AB+BN). This force F is an upward force. As such, most air within air chambers 12, 12A are concentrated on the underside of the neck of user. This ensures an optimal support for the neck of user. It is important to note that the invention is an ergonomic device such that musculoskeletal discomfort in the portions of the head and the neck of the user as experienced by prior art is totally eliminated. Moreover, water in water chamber may flow on the corrugated surface of air chamber due to the lateral movement of the head of user on pillow when use. This may cool the air temperature in the pillow for bringing a degree of comfort to user.

It is preferred that cold water is stored in water chambers. It is also allowable to add ice in water chambers for medical purposes. Or alternatively, add hot water or install a heating pad on the side of first water chamber 11 for adapting the pillow as warmer. In view of this, an additional medical effect is also carried out by the invention.

It is appreciated by those skilled in the art that other variations could be made without departing from the scope the invention. For example, water chamber is enclosed by air chamber. The number and shapes of water chambers and air chambers could be changed depending on the specific application.

While the invention herein disclosed has been described by means of specific embodiments, numerous modifications and variations could be made thereto by those skilled in the art without departing from the scope and spirit of the invention set forth in the claims.

What is claimed is:

1. An inflatable cervical pillow formed of an airtight thermoplastic material, the pillow comprising:

a first water chamber including a valve projected above a surface of the first water chamber; and a first air chamber including a valve projected above the surface of the first water chamber, the first air chamber being located within the first water chamber;

wherein the first air chamber is substantially a U-shaped member and the pillow has a slope curvature of between 35 and 45 degrees from a lowest front end to a highest rear end.

2. The cervical pillow of claim 1, wherein a surface area of the first air chamber is larger than a surface area of the first water chamber and the first air chamber has a corrugated surface such that water in the first water chamber flows toward the corrugated surface of the first air chamber.

3. The cervical pillow of claim 1, further comprising an elongate water chamber enclosed by the U-shaped first air chamber.

4. The cervical pillow of claim 1, further comprising an elongate central chamber enclosed by the U-shaped first air chamber.

5. An inflatable cervical pillow formed of an airtight thermoplastic material, the pillow comprising:

a first water chamber including a valve projected above a surface of the first water chamber; and a first air chamber including a valve projected above the surface of the first water chamber, the first air chamber being located within the first water chamber;

wherein the pillow is curved from a lowest front end to a highest rear end and a surface area of the first air chamber being larger than a surface area of the first water chamber, the first air chamber having a corrugated surface such that water in the first water chamber flows toward the corrugated surface of the first air chamber.

6. The cervical pillow of claim 5, wherein the curvature of the pillow is preferably 40 degrees.

7. The cervical pillow of claim 5, further comprising a parallelepiped second water chamber enclosed by the first water chamber and a second air chamber enclosed by a second water chamber.

8. The cervical pillow of claim 5, wherein the first air chamber has a U-shape and further comprising an elongate central chamber enclosed by the U-shaped first air chamber.

9. The cervical pillow of claim 8, wherein the central chamber comprises one of an air chamber or water chamber.

10. The cervical pillow of claim 8, further comprising a divider in the central chamber dividing the central chamber into a first sub-chamber and a second sub-chamber in fluid communication with the first sub-chamber.

11. The cervical pillow of claim 5, wherein the first air chamber has a U-shape and further comprising an elongate water chamber and a substantially ring-shaped air chamber in the U-shaped first air chamber.

* * * * *